US006576184B1

(12) United States Patent
Griffon

(10) Patent No.: US 6,576,184 B1
(45) Date of Patent: Jun. 10, 2003

(54) TILTING TANK FOR PROCESSING LIQUID METAL AND DEVICE FOR SEALED CONNECTION WITH FIXED CHUTE

(75) Inventor: Jacques Griffon, Venon (FR)

(73) Assignee: Pechiney Rhenalu, Paris (FR)

( * ) Notice: Subject to any disclaimer, the term of this patent is extended or adjusted under 35 U.S.C. 154(b) by 0 days.

(21) Appl. No.: 09/806,497

(22) PCT Filed: Oct. 14, 1999

(86) PCT No.: PCT/FR99/02491

§ 371 (c)(1),
(2), (4) Date: Jun. 1, 2001

(87) PCT Pub. No.: WO00/21701

PCT Pub. Date: Apr. 20, 2000

(30) Foreign Application Priority Data

Oct. 15, 1998 (FR) ..... 98 13088

(51) Int. Cl.[7] ..... B22D 41/04

(52) U.S. Cl. ..... 266/240; 164/337; 222/604

(58) Field of Search ..... 266/240; 164/337; 222/604

(56) References Cited

U.S. PATENT DOCUMENTS 4,324,392 A * 4/1982 White et al. ..... 266/240
5,370,171 A * 12/1994 Fields et al. ..... 266/137

* cited by examiner

*Primary Examiner*—Melvyn Andrews
(74) *Attorney, Agent, or Firm*—Dennison, Schultz & Dougherty

(57) ABSTRACT

A tank for liquid metal processing tilting about an axis and fed by a fixed chute and pouring the liquid metal into a fixed evacuating chute. The tank includes at least a passage hole for supplying, discharging, or emptying the liquid metal arranged in one of its walls and extended by a mobile nozzle integral with the tank. At least the fixed evacuation chute merges with the tilting axis and the nozzle. Further, the fixed chute is assembled together by a linking device articulated in rotation about the tilting axis.

19 Claims, 3 Drawing Sheets

TILTING TANK FOR PROCESSING LIQUID METAL AND DEVICE FOR SEALED CONNECTION WITH FIXED CHUTE

FIELD OF THE INVENTION

The present invention concerns a tilting vessel for treatment of liquid metal, typically for the gas treatment or filtration of liquid aluminium or magnesium or their alloys, and its sealed connection device with fixed troughs used to feed or evacuate said liquid metal from the vessel.

DESCRIPTION OF RELATED ART

A vessel for the treatment of liquid metal by gases or filtration or simply for its storage, generally has a capacity of no more than 3 tonnes and comprises feed and outlet devices for the liquid metal. Said liquid metal enters and leaves the vessel continuously, however it is necessary to empty the vessel regularly either in full or in part by tilting about a horizontal axis at an angle which typically lies between 30° and 90°. In addition, the vessel may be provided with a special drainage hole positioned in its lower part.

The outlet device for the liquid metal comprises a port, or tap out, usually provided at the top of one of the vessel walls, extended by a casting spout to pour the liquid metal into a fixed evacuation trough. The feed device for supplying liquid metal from a fixed trough is generally of the same type. Typically the vessel is a rectangular parallelepiped and the tilting axis is parallel to its greatest length. It is essential that the articulated connection between the spout integral with the vessel and the fixed trough should remain impervious to liquid metal at high temperature, despite the repeated cycles of heating and cooling in the installation.

Liquid metal is known to be poured into a fixed trough perpendicular to the axis of horizontal tilting. The latter, usually positioned at the level of the tap out, is then offset outside the vessel and passes through the end common to the spout and trough which are arranged in continuation of one another.

When the vessel is tilted, it is seen that the outlet spout of the said vessel and the fixed trough form a variable angle, and that the connection between these two parts must be articulated and sealed. To achieve the seal of this articulation, a metal knuckle joint is known to be placed on the outside around the ends of the spout and fixed trough, and the inner surface of the said knuckle joint is packed with a lining, which may be graphite-based braided rope, to ensure the seal with the outer surfaces of the spout and the trough. Therefore, when the vessel is tilted, its outlet spout rubs against the lining of the knuckle joint, moving in sealed manner.

When tilted, the vessel provided with this arrangement requires considerable space, in particular when the tilt angle is 90°, this space requirement being due to the fact that the tilt axis passes through the end of the spout. In addition, metal may freeze in the articulated device, in particular between the metal knuckle joint, the spout and the trough, which complicates and substantially hinders maintenance or dismounting operations.

Also, furnaces for melting and storing liquid metal are known, having a large capacity (several dozen tonnes) which tilt about a horizontal axis and pour the liquid metal into a fixed trough positioned in the continuation of said axis, whose angle of tilt generally does not exceed 10 to 20°. In this case, a sealed rotating connection between the casting spout integral with the furnace, also positioned on the tilt axis, and the fixed trough of semi-circular section, consists of fitting and adjusting inside the latter the spout that is integral with the vessel which also has a semi-circular section slightly smaller in diameter, and of causing the two semi-circular parts to slide in rotation relative to one another by means of a seal lining, often in graphite-based, placed between the two.

Such device can only be used over small angles of tilt owing to the fact that the lining is pulled as soon as the tilt angle becomes fairly wide. Therefore, this device cannot be applied to treatment vessels, in particular to those which tilt at wide angles. In addition, it is difficult to obtain a good seal owing to the fact that said two parts fitted into one another have different dilation in diametrical direction, that the troughs easily deform after the numerous heat cycles they undergo, and that the clamping force of the lining cannot be adjusted. Moreover, there is a considerable risk of the device becoming blocked on account of the metal which may slide into and freeze inside the interstice between the spout and the trough.

The applicant therefore set out to avoid the above disadvantages and to develop a tilting vessel for treatment with reduced tilt volume which is simultaneously provided with an articulated connection device, between the spout integral with the vessel and the fixed trough, which is perfectly sealed while being of simple design and use (adjustment, maintenance, dismounting, cleaning) and without the possibility of said device causing freezing of the liquid metal.

SUMMARY OF THE INVENTION

The invention is a vessel for treating liquid metal, tilting about an axis, fed by a fixed trough and pouring said liquid metal into a fixed evacuation trough, said vessel comprising at least one passage hole for feeding, evacuating or emptying the liquid metal, arranged in one of its walls and extended by a so-called mobile spout integral with the vessel, characterized in that at least the axis of the fixed evacuation trough merges with the tilt axis.

Usually the axis of the feed trough also merges with the tilt axis. It is particularly advantageous to provide this arrangement for vessels which tilt at an angle greater than 30° which may reach 90°.

Generally, the vessel is at least approximately a rectangular parallelepiped, its walls possibly being slightly tapered, and the tilt axis is parallel to its greater length, that is to say parallel to the longer walls and perpendicular to the shorter walls.

Said tilt axis preferably passes through an upper angle of said shorter walls; in this case, it not only merges with the axes of the fixed troughs and mobile casting or feed spouts, but also with those of the casting or feed holes. But it may very well be located at another point of the vessel or even offset outside the vessel; in this case it again merges with the axes of the fixed troughs and mobile spouts.

According to the invention, the ends of the mobile spouts and fixed troughs having a circular section, aligned along the tilt axis, are linked by a connection device articulated in rotation about said axis, impervious to liquid metal, able to rotate at an angle of more than 30° which may reach 90° without losing its seal properties and thereby allowing full or partial emptying of the vessel.

Said device articulated in rotation according to the invention comprises:

an adapter flange secured to the end of the spout, centred over the tilt axis, comprising a circular seal bearing whose plane is perpendicular to said axis, a connection flange secured to the end of the fixed trough, centred over the tilt axis, comprising a circular seal bearing whose plane is perpendicular to said axis, facing and co-operating with the preceding seal bearing;

at least one seal resistant to heat and liquid metal positioned between the two bearings;

a clamp device, optionally supported by a fixed part, used to adjust and maintain the clamping of the flanges relative to one another to ensure the sealed connection while allowing said flanges to pivot relative to one another.

Preferably two graphite-based seals are provided, one fixed to the bearing of each flange, which rub against one another.

The mobile spout and fixed trough being positioned in continuation one after the other so that the bearings of the seals which face one another correspond perfectly, it is advantageous to place centering means on each of the flanges which co-operate together and may form a centering device.

Therefore one of the flanges may comprise a cylindrical projection at whose end the seal bearing may be placed; this circular projection, like the flange, is designed so that it slide fits into a corresponding housing positioned on the other flange at the bottom of which the other seal bearing may be placed so that it faces the bearing of the first flange. It is seen that these two parts, by fitting into one another, ensure the centering of the seal bearings.

To achieve the liquid metal seal, while maintaining an appropriate friction force to enable the rotation of one flange relative to the other, all that is needed is to tighten the two seals against each other using the clamp device. To prevent the fixed trough from being pulled when the spout rotates, it is advantageous to reinforce its immobilisation in the vicinity of the connection flange, for example by means of reinforcement bars integral with a frame.

The clamp device may comprise screw tie rods supported firstly by one of the support parts integral with the frame, either fixed or preferably manoeuvrable, and secondly on the connection flange via elastic parts, for example springs or cambered washers of "belleville" type. Nuts are used to adjust the clamping force by compressing the elastic parts as required. The elastic parts also enable the seal to be maintained during heat cycles by absorbing the dilatations.

It can be seen that with this kind of device, in which the dilatations occur in the axis, it is possible to overcome recurrent or endemic deformations due to the heat cycles to which the unit is subjected during stoppage and re-start up of the vessel, and to achieve the desired seal while preventing any undue leakage or freezing of the liquid metal which could hinder vessel operation. Also, to dismount the device for its cleaning or maintenance (for example to change the seals) all that is required is to draw the two flanges away from one another.

To facilitate dismounting, it is also possible to extend the connection flange by a portion of fixed trough secured to the actual fixed trough by means of a rigid fixing device (for example using flanges integral with the trough and the portion of trough, bolted together) that is sealed, easy to dismount and accessible, and to lay the entire unit (portion of fixed trough, connection flange, clamp device) on a mobile carriage which also carries the support frame for the clamp device. To dismount, the fixed trough only needs to be uncoupled from the portion of trough and the latter can then be drawn away, with its connection flange, from the mobile spout fitted with its adapter flange after releasing the clamp device.

The flanges are generally in steel or refractory cast iron; the inside of the portion of fixed trough may be lined with the same refractory product as the spouts, troughs or vessel for liquid metal.

The device of the invention applies to the connection of the liquid metal vessel to its evacuation trough as well as to its feed trough. When it applies to both, the latter are positioned on the same axis, as described above.

The invention also concerns vessels for liquid metal comprising one or more articulated connection devices, and the processes which use the vessels or said devices according to the invention. These processes are in particular filtration or gas treatment of liquid metals such as aluminium, magnesium or their alloys.

DESCRIPTION OF THE PREFERRED EMBODIMENTS

Figure 1:
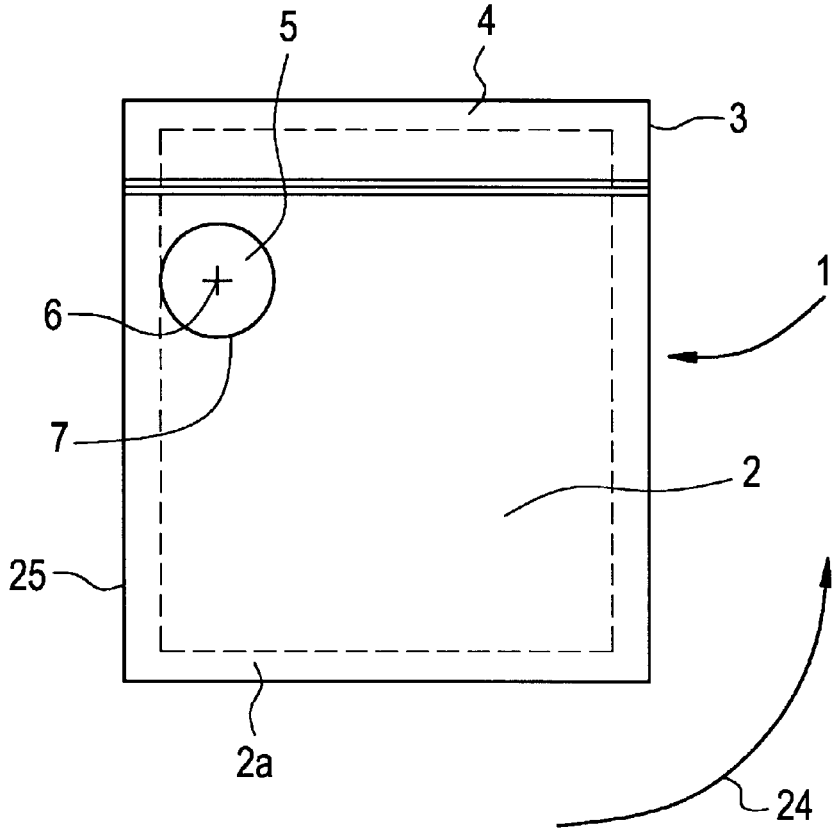
FIG. 1 illustrates the invention and shows a view of a vessel for liquid metal whose tilt axis passes through the upper part of one of its walls.

FIG. 1 shows the positioning of a passage hole 5 for casting, emptying or feeding the liquid metal, and of the spout 7 extending it towards a shorter wall 2 of vessel 1. The passage hole 5 is located in the upper part of said vessel, adjacent to a long wall 25 (cross-section view) perpendicular to the short wall 2. The tilt axis 6 passes through its centre and is parallel to said long wall 25. It can be seen that by means of this arrangement and the sealed, articulated connection device according to the invention, it is easily possible to empty the vessel completely by tilting it in the direction of the arrow 24, the space needed for this operation being reduced to the minimum.

Figure 2:
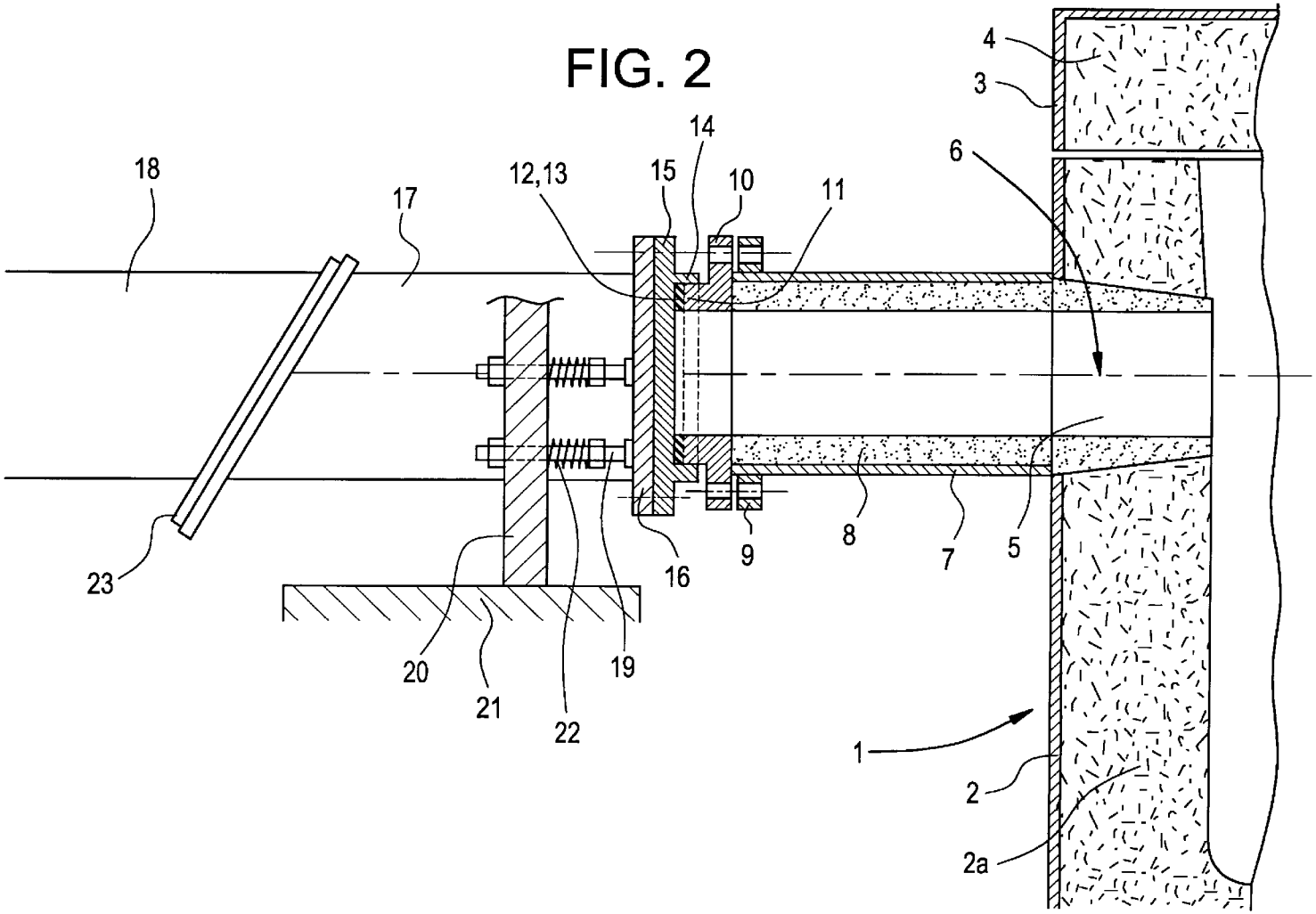
FIG. 2 shows a profile view of a connection articulated in rotation mounted on a vessel for liquid metal of the type shown in FIG. 1.

In FIG. 2, reference 1 shows a vessel for liquid metal which is parallelepiped, with a short wall 2 that is slightly tapered, coated on the inside with a refractory material 2*a* and a lid 3 also coated on the inside with a refractory material 4. At the top part of vessel 1 is a passage hole 5 for casting, emptying or feeding the liquid metal. The vessel tilts about the tilt axis 6 passing through said passage hole 5. The latter is extended by a mobile spout 7 integral with vessel 1, and pivots with the latter; it is coated on the inside with a refractory material 8.

The adjustable clamping of seals 12, 13 may be made by screw tie rods 19 which are supported by a fixed part 20 integral with a frame 21, by means of a spring 22 whose compression is adjusted by nuts.

Figure 3:
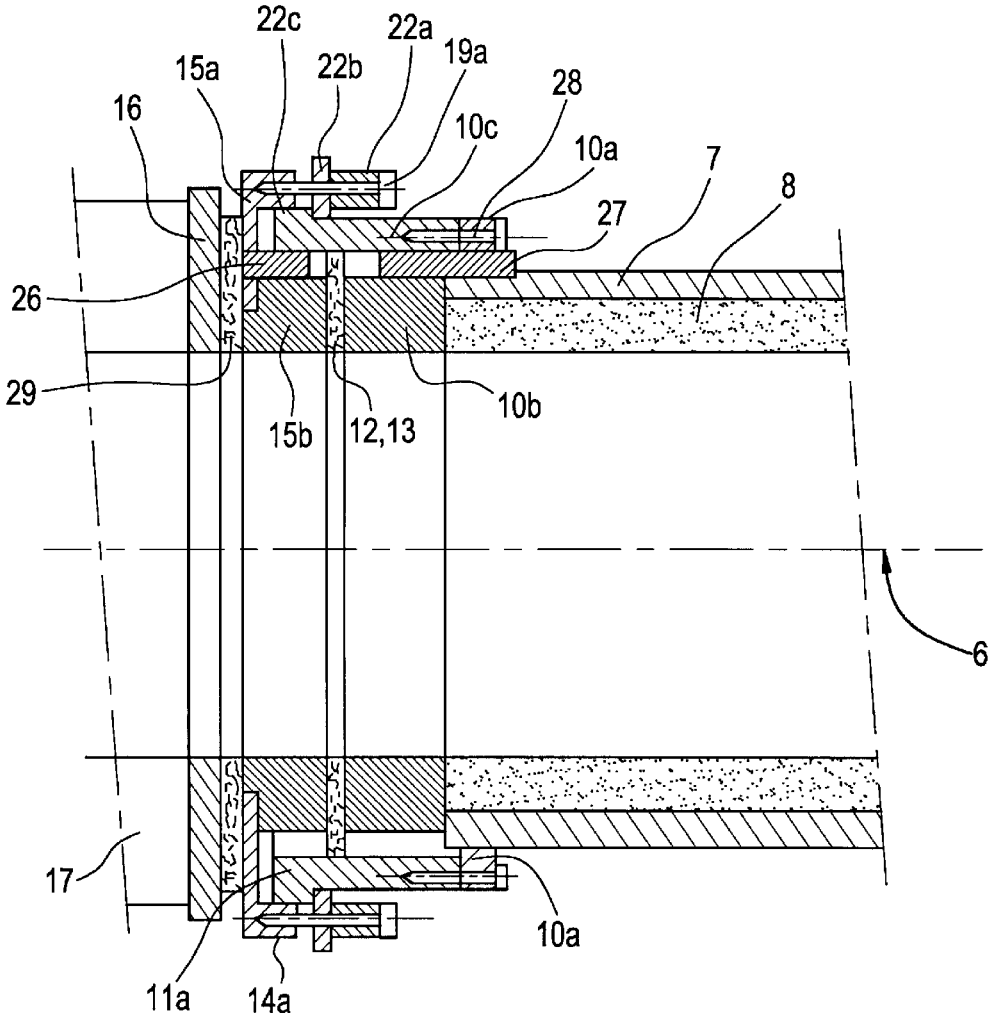
FIG. 3 shows a profile view of the preferred embodiment of the connection articulated in rotation according to the invention.

As shown in FIGS. 2 and 3, the connection devices sealed against liquid metal, articulating in rotation about an axis 6 and enabling titling of vessel 1 of liquid metal, comprises:

an adapter flange 10, 10*a*, 10*b*, 10*c* secured to the end of spout 7, 8, centred over the tilt axis 6 and comprising a circular seal bearing perpendicular to said axis 6;

a connection flange 15, 15*a*, 15*b* secured to the end of the fixed trough 17, 18, centred over the tilt axis 6 and comprising a circular seal bearing perpendicular to said axis 6, facing and co-operating with the preceding bearing;

at least one seal 12, 13 resistant to heat and liquid metal, positioned between the two bearings;

a clamp device 19, 19*a*, 22, 22*a*, 22*b*, 22*c* used to adjust the clamp force of flanges 10, 10*a*, 10*b*, 10*c*, 15, 15*a*, 15*b* relative to one another, in order to ensure the seal of the connection while allowing said flanges 10, 10*a*, 10*b*, 10*c*, 15, 15*a*, 15*b* to pivot relative to one another.

The connection device of the invention advantageously comprises a centering device 11, 11*a*, 14, 14*a* for flanges 10, 10*a*, 10*b*, 10*c*, 15, 15*a*, 15*b* to center the latter relative to one another. This centering device may comprise, on one of flanges 10, 10*a*, 10*b*, 10*c*, 15, 15*a*, 15*b*, a cylindrical projection 11, 11*a* which slide fits into a corresponding housing 14, 14*a* positioned on the other flange 10, 10*a*, 10*b*, 10*c*, 15, 15*a*, 15*b*. According to the variant shown in FIG. 2, one of the seal bearings may be positioned at the end of projection 11, the other seal bearing being positioned in the bottom part of housing 14 so that the two seal bearings face one another. According to the variant in FIG. 3, the seal bearings are provided at the end of specific projections 15*b*, 10*b* of flanges 10*a*, 10*b*, 10*c*, 15, 15*a*, 15*b*, said bearings being arranged so that they face one another.

According to a first embodiment of the invention, the adjustable clamp device comprises screw tie rods 19 supported firstly by one or more fixed support parts 20, preferably integral with a frame 21, and secondly by one of flanges 10, 15 via elastic parts or a spring 22; nuts are used to adjust the compression and therefore the clamping force.

According to a second embodiment of the invention, the adjustable clamp device comprises a projection 22*c* on one of flanges 10, 10*a*, 10*b*, 10*c*, 15, 15*a*, 15*b*, a ring flange 22*b* and clamp adjusting means 19*a*, 22*a*, such as bolts 19*a* and washers of "belleville" type 22*a*. This variant further simplifies the opening and dismounting of the connection device.

Spout 7 may comprise a counter-flange 9 at its end, on which the adapter flange 10 is fixed in sealed manner comprising a cylindrical projection 11. According to one variant of the invention, on the seal bearing positioned at the end of said projection 11, seal 12 is placed which is preferably a graphite-based seal. This seal 12 is applied against the corresponding seal 13 positioned on the seal bearing located in the bottom part of cylindrical housing 14 forming part of connection flange 15 and co-operating with projection 11 to center the device. According to another variant of the invention, flanges 10, 10*a*, 10*b*, 10*c*, 15, 15*a*, 15*b* may comprise several separate parts which are preferably fixed to one another, for example by means of rotating stop parts 26, 27 or fixation means 28. The rotating stop parts 26, 27 may be welded to the corresponding flanges 10*b*, 15*b* and specific housings may be provided in corresponding flanges 10*a*, 15*a*.

The connection flange 15, 15*a*, 15*b* is fixed by means of a counter-flange 16 onto a removable portion of fixed trough 17 positioned in the continuation of the main body of the fixed trough 18. A device 23 is seen for the sealed coupling of the main body 18 to the removable portion 17 of the fixed trough.

It may be advantageous to provide a seal 29 resistant to heat and liquid metal, between the connection flange 15, 15*a*, 15*b* and the counter-flange 16.

What is claimed is:

1. In combination, a treatment vessel for molten metal comprising a wall having a passage hole therethrough for supplying, discharging or emptying the liquid metal, said passage being extended by a mobile spout integral with the vessel, said vessel being rotatable about a horizontal axis between a first position in which the vessel is upright with the hole in an upper portion thereof, and a second position in which the vessel is tilted with the hole in a lower position for evacuation of liquid metal therein;

an evacuation trough having a longitudinal axis, and positioned such that the horizontal axis of rotation of the vessel is substantially coincident with the longitudinal axis of the trough; and connection means for sealing the trough to the spout.

2. The combination according to claim 1, wherein the vessel is a rectangular parallelepiped with a greater length and a lesser length, the horizontal axis of rotation being parallel to the greater length, and is either offset outside the vessel or is positioned at its upper part.

3. The combination according to claim 1, wherein the angle between the first position and second position is between 30° and 90°.

4. The combination according to claim 1, wherein at least one end part of the fixed trough and of the mobile spout have a circular section and are connected by said connection means articulated in rotation about the axis of rotation and sealed against liquid metal.

5. Connection device for connecting an outlet hole in a wall of a rotatable vessel for treatment of liquid metal with a fixed trough for receiving liquid metal from the vessel and which has an horizontal axis, the vessel having a horizontal axis of rotation which is substantially coincident with the horizontal axis of the trough, the connection device comprising:

a mobile spout extending outwardly from the outlet hole and having a horizontal axis coincident with the horizontal axis of the vessel, and terminating at an end opposite to the outlet hole and having a circular section;

an adapter flange secured to the end of the mobile spout centered over the horizontal axis of rotation and comprising a circular seal bearing perpendicular to said axis;

a connection flange constructed and arranged to be secured to an end of the fixed trough centered over the horizontal axis of rotation and comprising a circular seal bearing, perpendicular to said axis facing and co-operating with the bearing of the adapter flange;

at least one seal resistant to heat and liquid metal, positioned between the adapter flange bearing and the connection flange bearing; and a clamp device optionally supported by a fixed part, constructed and arranged to adjust clamping of the connection flange and the adapter flange relative to one another, and to ensure sealing of a connection between the mobile spout and the fixed trough, while allowing said flanges to pivot relative to one another.

6. Device according to claim 5, wherein the flanges comprise a centering device for their centering relative to one another.

7. Device according to claim 6, wherein the centering device comprises on one of the flanges a cylindrical projection which slide fits into a corresponding housing positioned on the other flange.

8. Device according to claim 7, wherein one seal bearing is located at the end of the cylindrical projection and another seal bearing is located in the bottom part of housing so that the two seal bearings face one another.

9. Device according to claim 7, further comprising two specific projections of flanges, a seal bearing being placed at the end of each one, arranged so that the two seal bearings face one another.

10. Device according to claim 5, further comprising two seals, one on each bearing.

11. Device according to claim 5, wherein the flanges are formed of steel or refractory cast iron.

12. Device according to claim 5, wherein the adjustable clamp device comprises screw tie rods supported firstly by one or more fixed support parts, and secondly by one of said flanges, via elastic parts, nuts being used to adjust the clamping force.

13. Device according to claim 5, wherein the adjustable clamp device comprises a projection on one of said flanges, a ring flange and clamp adjusting means.

14. Device according to claim 13, wherein the clamp adjusting means comprises bolts and belleville washers.

15. Device according to claim 5, wherein the seals are graphite based.

16. A method for treating molten metal in a vessel comprising a wall having a passage hole therethrough for supplying, discharging or emptying the liquid metal, said passage being extended by a mobile spout integral with the vessel, comprising the steps of:

sealing the spout to the trough;

introducing liquid metal into the vessel;

carrying out a treatment of the liquid metal within the vessel;

evacuating the treated liquid metal from the vessel by rotating the vessel on a horizontal axis of rotation between a first position in which the vessel is upright with the hole in an upper portion thereof, and a second position in which the vessel is tilted with the hole in a lower position, with the horizontal axis of rotation being substantially coincident with a horizontal axis of an evacuation trough; and evacuating the liquid metal into the trough.

17. Process according to claim 16, wherein the treatment comprises gas or filtration treatment of liquid aluminum, magnesium, or alloys thereof.

18. Process according to claim 16, wherein the step of sealing the spout to the trough comprises:

moving an adapter flange secured to the end of the mobile spout centered over the horizontal axis of rotation and comprising a circular seal bearing perpendicular to said axis, opposite to a connection flange secured to an end of the fixed trough centered over the horizontal axis of rotation and comprising a circular seal bearing, perpendicular to said axis, such that the bearing of the connection flange faces and co-operates with the bearing of the adapter flange, with at least one seal resistant to heat and liquid metal, positioned between the connection flange bearing and the adapter flange bearing; and adjusting a clamp device optionally supported by a fixed part, to adjust clamping of the connection flange and the adapter flange relative to one another, and to ensure sealing of a connection between the mobile spout and the fixed trough, while allowing said flanges to pivot relative to one another.

19. Process according to claim 18, wherein the treatment comprises gas or filtration treatment of liquid aluminum, magnesium, or alloys thereof.

* * * * *